US005090083A

United States Patent [19]

Wulff

[11] Patent Number: 5,090,083

[45] Date of Patent: Feb. 25, 1992

[54] WIDE AREA CARPET VACUUM CLEANER

[75] Inventor: Richard E. Wulff, Maple Plain, Minn.

[73] Assignee: Castex Industries, Inc., Holland, Mich.

[21] Appl. No.: 526,605

[22] Filed: May 22, 1990

[51] Int. Cl.[5] ..... A47L 5/30; A47L 9/20

[52] U.S. Cl. ..... 15/347; 15/349; 15/352; 55/305

[58] Field of Search ..... 15/347, 349, 352; 55/305

[56] References Cited

U.S. PATENT DOCUMENTS

| | | | |
|---|---|---|---|
| 2,077,572 | 4/1937 | Lotgren | 55/305 X |
| 3,233,274 | 2/1966 | Kroll | 15/352 X |
| 3,461,479 | 8/1969 | Tierney | 15/352 X |
| 3,484,889 | 12/1969 | McCandless | 55/305 X |
| 3,653,190 | 4/1972 | Lee et al. | 15/352 X |
| 4,032,307 | 6/1977 | Sommerfeld | 15/352 X |
| 4,716,621 | 1/1988 | Zoni | 15/352 X |
| 4,819,676 | 4/1989 | Blehert et al. | 15/352 X |

OTHER PUBLICATIONS

1989 Literature-National Super Service Company, Form 31: 0189.

Undated Literature from Windsor Industries, Inc.

*Primary Examiner*—Chris K. Moore

*Attorney, Agent, or Firm*—Price, Heneveld, Cooper, DeWitt & Litton

[57] ABSTRACT

The specification discloses a wheeled commercial carpet vacuum cleaner having wide area coverage, an integral one piece molded polymer housing enclosing a debris hopper with a plurality of inverted filter tubes therabove and enclosed by a filter housing in engagement with the hopper. The open bottom filter tubes are normally retained up in extended condition by springs therein which are compressible under the action of a manually operable depressor plate, plunger and linkage via an external handle, to act as a shaker distorting the tubes to dislodge dirt from the filter inner walls and allow it to fall into the debris hopper. One or more vacuum motors and suction fans are operable connected to the filter housing. A vacuum conduit extends between the area adjacnet a carpet-engaging power brush and the debris hopper. The suction fans pull dirt-laden air from the brush area through the tube and into the hopper, and from there up through the filter tubes. All of these components are enclosed within the vacuum cleaner housing which is of one-piece construction except for the cover and a hopper door through which the hopper is removed for dumping. The filter housing is disengaged and lifted from the hopper with opening of the hopper door.

9 Claims, 3 Drawing Sheets

WIDE AREA CARPET VACUUM CLEANER

BACKGROUND OF THE INVENTION

This invention relates to commercial carpet cleaners, particularly for carpet vacuum cleaning.

Commercial carpet vacuum cleaning machines have been available for years, such typically employing an external bag into which dirt-laden air is propelled. Removal and cleaning of the bag is a cumbersome and dirty task. One manufacturer of cleaners causes the bag to be enclosed during operation, but it must still be removed for emptying the bag. Emptying is still dirty. Another manufacturer has the external bag mounted above a hopper, the bag being engaged with the hopper using releasable latches for releasing the bag and emptying debris from the hopper. The dusty bag is still exposed during operation and must be manually beat in order to dislodge the dirt.

SUMMARY OF THE INVENTION

The inventor herein determined that it would be advantageous to have no exposed bag and to eliminate the task of manually removing and emptying the bag, thereby causing the overall task to be cleaner.

The present invention incorporates within a polymeric integral housing enclosing a self contained vacuum assembly including an open top debris hopper releasably engaged with an inverted filter housing that extends around a plurality of inverted compressible filter tubes. These filter tubes are normally retained in extended condition by inner compressible spring elements A handle outside the housing is connected by linkage to a plate positioned to repeatedly depress and thereby distort the filter tubes when actuated. This causes dirt to be dislodged from the inner walls of the filter tubes, to fall into the hopper. Vacuum motors and pumps draw dirt-laden air from the area of the power brush through a vacuum conduit to the hopper, and thence up through the filter tubes for filtration. A filter housing lifting device is connected via linkage to a hopper door in the housing so that, when the hopper door is opened to remove the hopper for dumping, the filter housing is disengaged from and lifted away from the hopper.

Although it is understood that filter tubes of some sort have been employed heretofore in street sweeper vehicles, it is not believed that the present carpet cleaning invention has been known.

The resulting carpet vacuum cleaner of this invention is remarkably clean and quiet in operation, capable of cleaning a wide span. The power brush readily helps propel the wide vacuum cleaner along the floor, as well as picking up dirt. Most of the weight of the machinery is above and slightly offset forwardly of a rear axle on which a pair of rear wheels are mounted, causing the center of gravity to also be offset a small amount toward the front. Hence, the vacuum cleaner can be readily tilted about the rear axle to lift the front swivel wheel and the brush from engagement with the floor.

These and other features, objects and advantages of the invention will be apparent upon studying the following specification in conjunction with the drawings

DESCRIPTION OF THE PREFERRED EMBODIMENT

Figure 1:
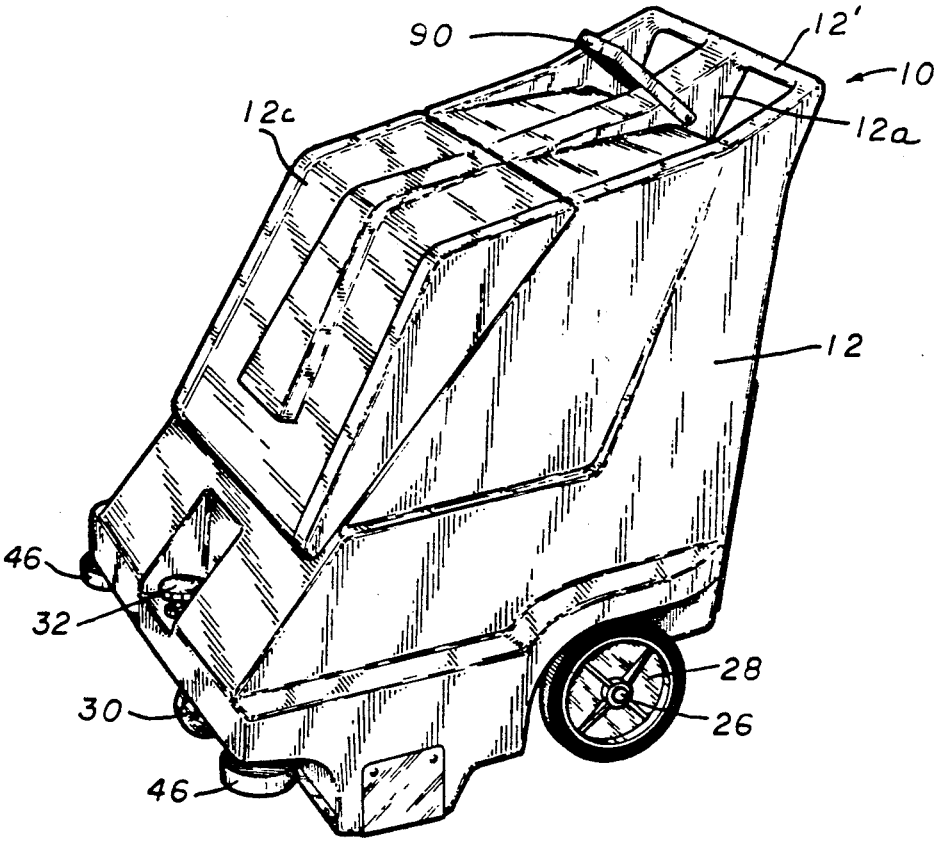
FIG. 1 is a perspective view of the novel vacuum cleaner.

Referring now specifically to the drawings, the power vacuum cleaner 10 has a housing 12 and removable housing cover **12*c* to form a basically two-piece molded polymeric structure enclosing the operative components therein. At the rear of this housing is a hopper door 14 which is the one component of the housing not integral with the rest. This hopper door closes a laterally elongated opening (FIG. 5) of a height and width sufficient to remove a laterally elongated debris hopper 60 to be described more fully hereinafter. Door 14 has an elongated hinge 14'' at its lower edge 14' connecting it to the housing. It is normally retained tightly against the remainder of the housing by a conventional latch mechanism 16 at the door upper edge, the latch being held by coil spring 16'. The door may be opened or closed by a pivotal U-shaped handle 18. The vacuum cleaner is designed to be moved over a carpet surface to be cleaned. Facilitating this is an integral, rigid, rearwardly extending double handle 12' at the upper rear of the machine, enabling the carpet vacuum cleaner to be controlled by the left hand, the right hand, or both hands. This handle is integral with and supported by two end supports and a center support 12*a*. Beneath this projecting handle, the rear vertical wall of the housing containing hopper door 14** is sloped downwardly and ahead, away from the operator.

Figure 2:
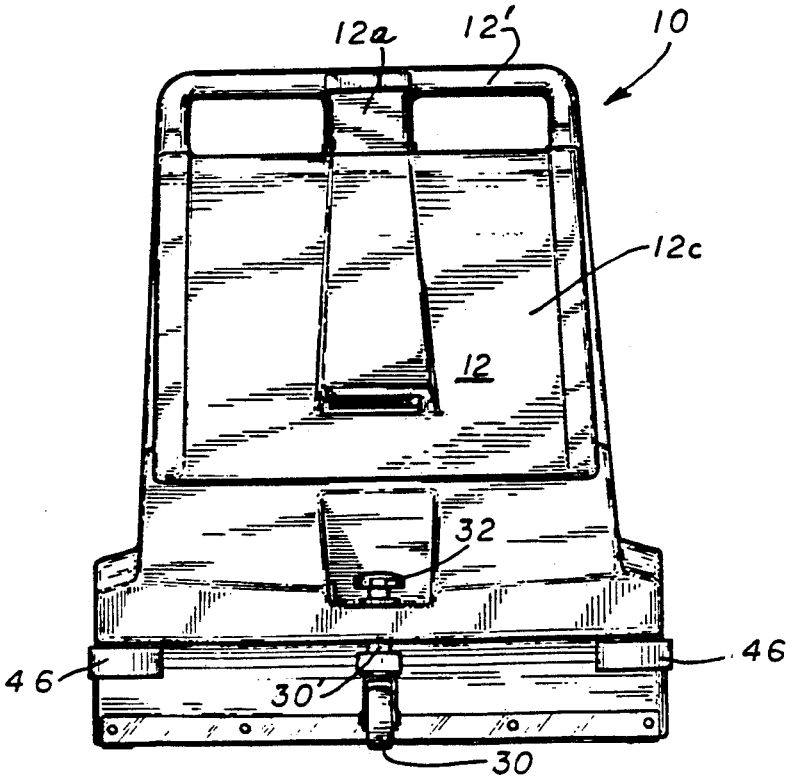
FIG. 2 is a front elevational view of the vacuum cleaner.
Figure 3:
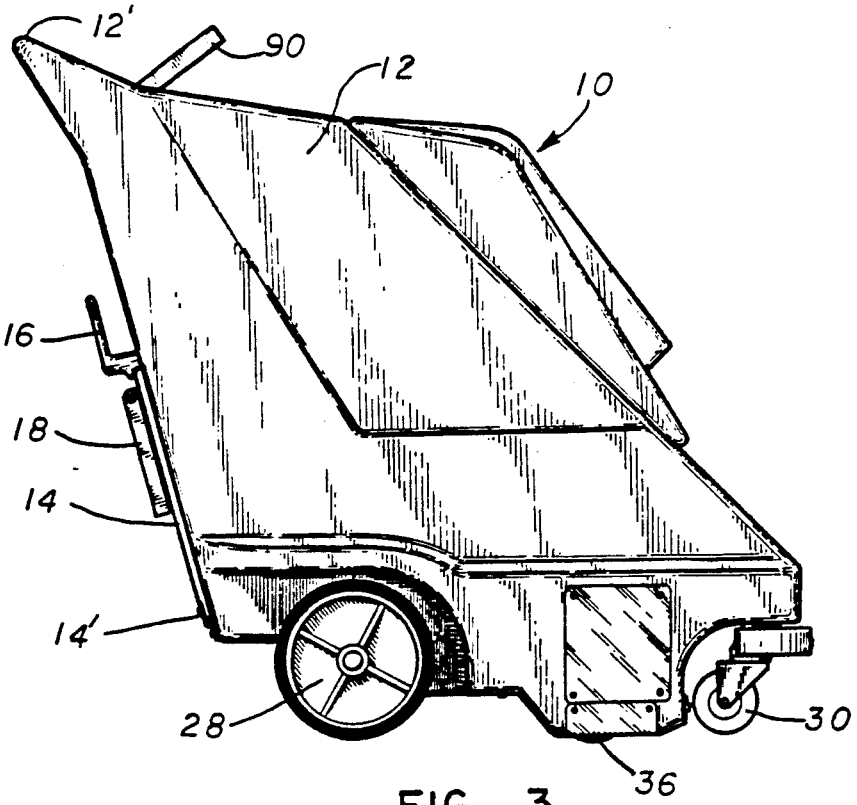
FIG. 3 is a side elevational view of the vacuum cleaner.
Figure 4:
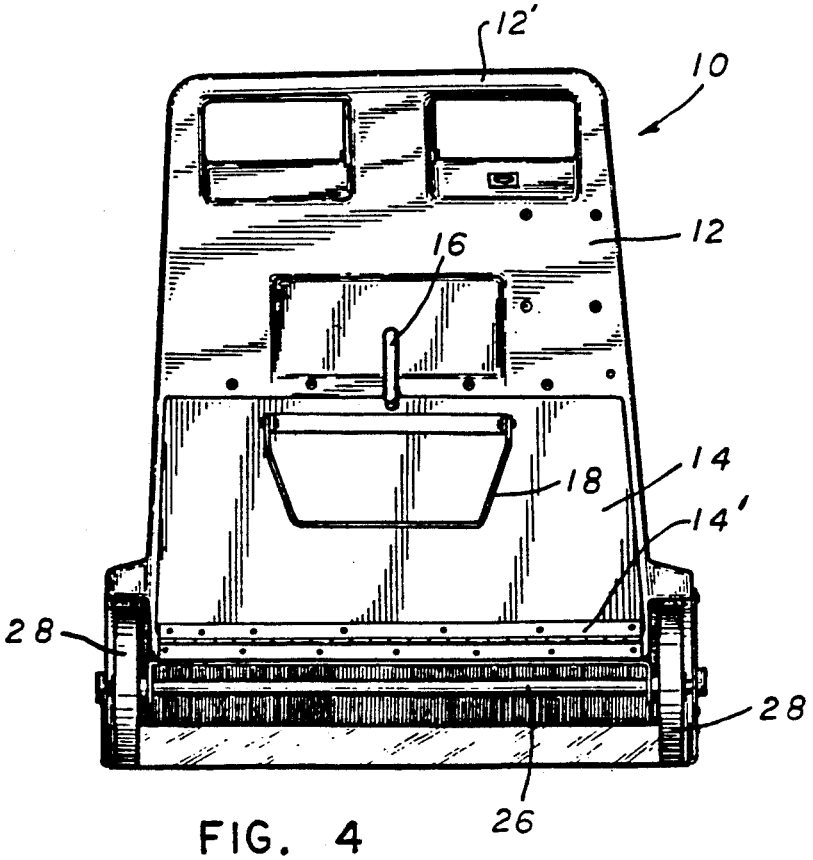
FIG. 4 is a rear elevational view of the vacuum cleaner.

The machine is chiefly supported on a transverse axle 26 having a pair of wheels 28 at its ends. This axle and its wheels are offset from the center of the machine, and from the center of gravity of the machine, toward the rear. At the front end of the machine is a central swivel wheel 30 mounted on a vertical pivot axle 30'. The elevation of the housing relative to wheel 30 can be adjusted using upper end knob 32 (FIG. 2), thereby enabling the height of the housing and its power brush (to be described) to be adjusted relative to the floor. Forwardly of wheels 28 and rearwardly of wheel 30 is a transversely oriented, elongated, cylindrical power brush 36 fixed on but rotatable relative to the housing. Adjustment of the housing elevation with knob 32 thus vertically adjusts this power brush to a desired height relative to the carpet. Power brush 36 is of conventional construction, comprising a cylindrical core and radially extending bristles, typically in a chevron pattern from the ends to the center of the core. This power brush is driven by electric motor 40 through a belt 42.

Figure 5:
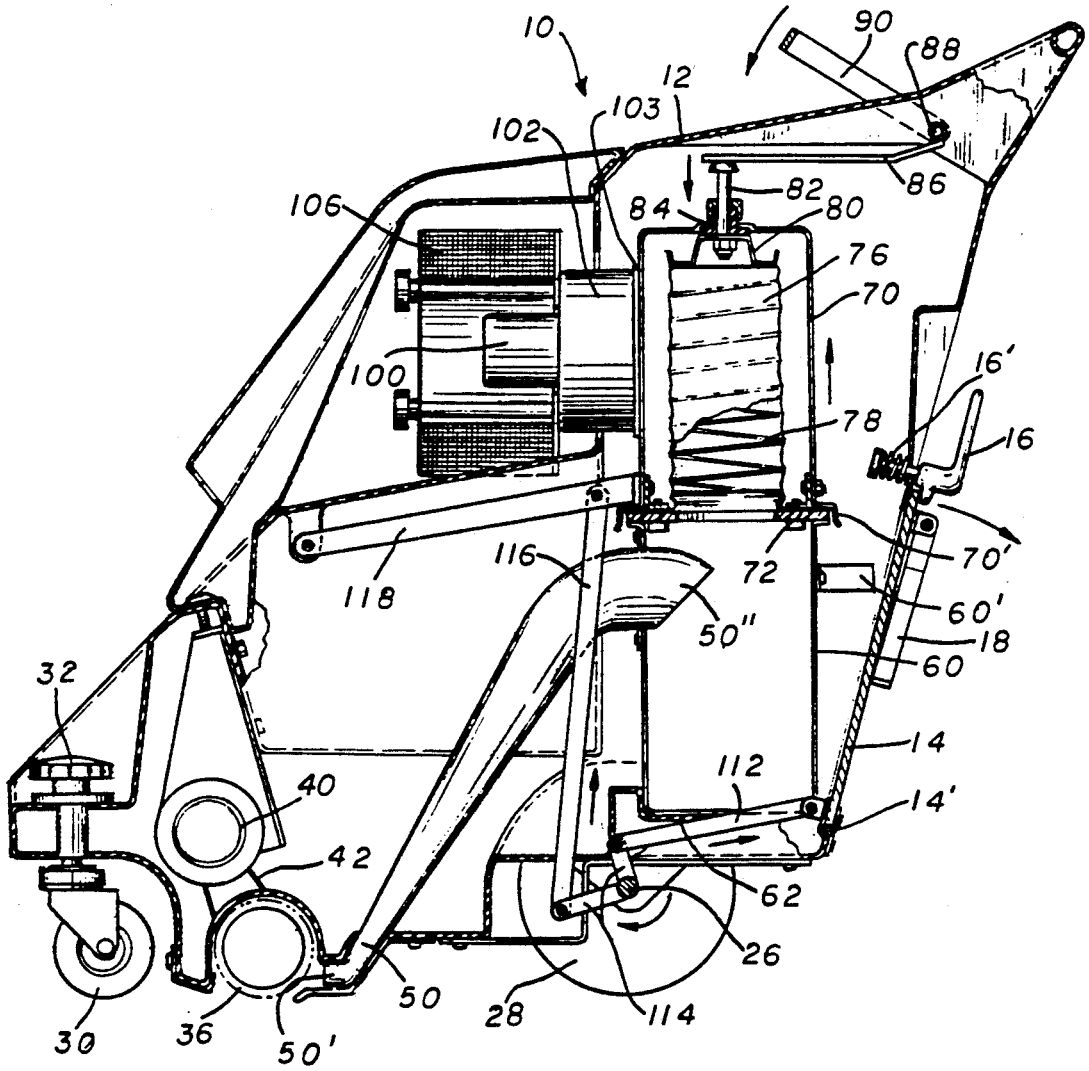
FIG. 5 is a sectional side elevational view of the vacuum cleaner showing the internal components.

Adjacent the front corners of the machine is a pair of horizontally rotatable bumper wheels 46 which project laterally beyond the housing side walls to engage any building wall surfaces or furniture adjacent which the machine is operated, and thereby inhibit scuffing The bottom of housing 12 is curved up around the top of power brush 36 (FIG. 5) and across the bottom of the machine to enclose the space within the housing. Extending through the housing bottom is the receiving open end 50' of a vacuum conduit 50 having a width adjacent power brush 36 substantially equal to the width of the power brush, to receive dirt-laden air adjacent the power brush. The dirt is briskly swept and propelled from the carpet to the rear by the power brush, being then entrained in air drawn by vacuum up through the vacuum conduit as described hereinafter. The wide receiving end of the vacuum conduit tapers to a laterally narrower portion approaching its outlet 50'' inside debris hopper 60 within housing 12. Conduit 50 extends through the front wall of the hopper as depicted (FIG. 5). Hopper 60 is supported by a hopper support member 62 at the bottom of housing 12. Hopper 60 is transversely elongated, having a generally rectangular configuration open at the top. This open top is covered by a filter housing 70. Positioned around the periphery of the open top is a filter plate forming a gasket 72 open at its center, and being retained against the top flange of hopper 60 by the bottom flange of filter housing 70. This filter housing is also transversely elongated, generally corresponding to the dimensions of hopper 60, its open bottom generally corresponding to the open top of the hopper, and having a peripheral skirt type flange 70' overlapping the flange of hopper 60. Gasket 72 is engaged between the flanges.

Within filter housing 70 is a plurality, here four, of cylindrical filter tubes 76 secured at the periphery of their open lower end to the bottom of housing 70, and extending upwardly into housing 70. These filter tubes are closed on the outer periphery and the upper ends thereof. They are sealed at the lower end to housing 70 and gasket 72. They are made of flexible cloth-type material having a porosity enabling air to pass through, but retaining dirt on the inner walls thereof. They are supported in an upwardly extended condition by spring elements such as compressible helical springs 78 of metal or plastic engaging the inner walls and the upper ends of the respective filters. The filter tubes can be depressed by compressing the springs downwardly by force upon the upper ends. Such compression distortion of the filter tubes, especially if repeatedly and vigorously performed, causes dirt clinging to the inner walls thereof to be dislodged and dropped by gravity down into hopper 60.

This depression of filter tubes 76 is achieved through a special mechanism including a transversely elongated plate element 80 within housing 70 and engageable with the upper ends of the filter tubes. This plate has a vertically raised center for the attachment of the lower end of a plunger 82 which extends through filter housing 70 and seal 84. The upper end of the plunger has a head engaged by the outer end of a pivotal lever 86 pivoted on shaft 88. Also affixed to shaft 88 is a U-shaped handle 90. This handle is outside the housing 12 and straddles the center support **12*a* of handle 12'. Rod 88 extends through this support and engages handle 90 at both ends of the rod. Thus, the entire shaker mechanism, except for the exposed handle, is within housing 12**.

A vacuum motor 100, or preferably two motors side-by-side, is operably connected to one, or preferably two, rotary suction fans 102 of conventional bladed type, which serve as vacuum pumps. The inlet to each suction fan 102 is in communication with the interior of filter housing 70 outside of filter tubes 76. A flat motor protection filter 103 is located between each suction fan 102 and filter housing 70 to protect the suction fan in the event of failure of any of filter tubes 76. Thus, by operation of motor 100 and suction fan 102, a negative pressure is applied to the interior of filter housing 70 and thus through the filters to the interior of filter tubes 76, to debris hopper 60 and vacuum conduit 50. This draws air past the power brush 36 to thereby pick up any debris, dirt, dust, etc. swept by the brush, all often referred to herein as debris, for drawing such debris-laden air through vacuum tube 50 and into hopper 60 where larger pieces of debris fall into the hopper. The air containing smaller particles such as dust is then drawn up through tube filters 76 which filter the dust, through filters 103, thence into suction fans 102 and out into the housing where the air discharges from the housing around the periphery of housing cover **12*c*. Optionally, a H.E.P.A. filter 106 may be applied to the discharge of each pump 102** for use of the equipment in hospitals or the like.

At appropriate times, the hopper is emptied. This is achieved by unlatching latch 16 and lowering the hopper door as with handle 18. Actuation of this door not only allows access to debris hopper 60, but also causes the filter housing to be disengaged from hopper 60 by lifting the filter housing and contents thereof More specifically, this occurs through a linkage attached to hopper door 14 and filter housing 70. This linkage is shown to include a link 112 pivotally connected at one end to door 14 offset from hinge 14' and pivotally connected at the other end to one end of a dogleg link 114. Link 114 is pivoted at its apex to axle 26 and pivotally connected at its opposite end to one end of a vertical link 116. The upper end of link 116 is pivotally connected intermediate the ends of a support link 118. One end of link 118 is pivotally attached to the vacuum cleaner housing and the other end is attached to the filter housing. Opening of hopper door 14 thus shifts the various links in the manner indicated by the arrows in FIG. 5, i.e., pulls link 112 which pivots dogleg link 114 in a clockwise direction (as depicted in FIG. 5), to lift link 116 and thereby link 118 for raising filter housing 70 a controlled amount out of engagement with debris hopper 60. By grasping handle 60' of debris hopper 60, it can be removed from the vacuum cleaner housing and emptied, after which it is replaced on its support 62 and, with closing of door 14, the filter housing is again lowered into sealing engagement with debris hopper 60.

This wide area vacuum cleaner eliminates dusty, clogged vacuum bags. Dirt and other debris are swept into the machine which is totally enclosed by its molded polymeric housing. Any airborne dust is channeled through the four filter tubes. At intervals, the shaker handle can be vigorously shifted back and forth to repeatedly distort the tubes by compressing the springs therein, causing the dust to be dislodged and fall from the filters into the slide out hopper The chevron pattern brush helps propel the unit. The swivel wheel allows 180° turns. The unit can be powered directly using an electric cord to a suitable outlet, or by battery power (not shown), if desired Conceivably, various details and features of this machine may be modified to suit a particular type facility or design. It is not intended that the invention should be limited by the details of the preferred illustrative embodiment set forth as exemplary of the invention, but only by the scope of the appended claims and the reasonably equivalent structures to those defined therein.

The embodiments of the invention in which an exclusive property or privilege is claimed are defined as follows:

1. A carpet vacuum cleaner comprising:

a vacuum cleaner housing and support wheels thereunder;

a power brush beneath said housing for engaging the carpet surface to be swept;

an open upper end debris hopper in said vacuum cleaner housing;

a conduit having an open end adjacent said power brush, and extending from said power brush to said debris hopper for conducting air and debris from said power brush to said debris hopper;

filter means having a tubular configuration with an open bottom above said debris hopper for filtering dirt from air drawn up through said conduit and flowing up through said tubular filter means;

said filter means having a periphery, and having an upper end closed by air permeable filter materials;

a filter housing in said vacuum cleaner housing and around said filter means;

said filter housing and said filter means being sealed to said hopper upper end;

suction fan means having communication through said filter housing to said conduit for drawing dirt-laden air up into and through said conduit and said filter means;

a motor means operably connected to said suction fan means for driving said suction fan means;

filter distorting means in said housing positioned for knocking dirt from said filter means into said debris hopper by temporarily distorting said filter means;

actuator means extending from said distorting means out through said vacuum cleaner housing for manual actuation thereof;

said filter means comprising a plurality of open bottom porous tubes having compressible extension means therein for normally extending said tubes but allowing said tubes to be compressed with distortion of said tubes for dislodging dirt therefrom;

said filter distorting means comprising a depressor engageable with said upper end of said filter means for selectively depressing and releasing said filter means and said compressible extension means therein, to dislodge dirt therefrom;

said actuator means comprising handle means external of said vacuum cleaner housing for actuating and releasing said depressor;

said depressor comprising a plate, a plunger for shifting said plate and linkage between said plunger and said handle means; and disengagement means operably connected for disengaging said filter housing from said hopper.

2. The carpet vacuum cleaner in claim 1 wherein said disengagement means comprises filter housing lift means for lifting said filter housing out of engagement with said hopper.

3. The carpet vacuum cleaner in claim 2 including a hopper door on said vacuum cleaner housing adjacent said hopper, for removal of said hopper from inside said vacuum cleaner housing for dumping; and said filter housing lift means is connected to said hopper door to actuate said lift means with opening of said hopper door.

4. The carpet vacuum cleaner in claim 1 including a hopper door on said vacuum cleaner housing for removal of said hopper, and wherein said vacuum cleaner housing comprises a molded one-piece enclosure, except for said hopper door.

5. A carpet vacuum cleaner comprising:

a molded polymeric vacuum cleaner housing forming an enclosure;

wheels and a power brush beneath said vacuum cleaner housing;

at least one motor and suction fan inside said housing;

a filter housing in said enclosure, and a debris hopper beneath said enclosure and in engagement with said filter housing;

filter means in said filter housing for filtering out dirt from dirt-laden air said filter means comprising a flexible filter element;

filter flexing means in said vacuum cleaner housing for temporarily flexing said flexible filter to dislodge dirt therefrom to allow the dirt to drop into said hopper;

a vacuum conduit from said power brush to said debris hopper;

said suction fan being in communication with said filter housing to draw dirt laden air from said brush through said vacuum conduit to said hopper, and from said debris hopper through said filter means;

a hopper door in said vacuum cleaner housing adjacent said debris hopper for removal and dumping of said hopper; and said filter housing being disengageable from said debris hopper to allow removal of said debris hopper.

6. The carpet vacuum cleaner in claim 5 wherein said filter means is flexible to dislodge dirt from said filter means into said debris hopper; and said filter flexing means is arranged to flex said filter means to dislodge dirt therefrom to fall into said hopper.

7. The carpet vacuum cleaner is claim 6 said filter flexing means comprises a shaker element in said vacuum cleaner housing, a handle outside said vacuum cleaner housing, and means for connecting said shaker element and said handle.

8. The carpet vacuum cleaner in claim 7 wherein said means for connecting said shaker element and said handle includes a plunger extending through said filter housing.

9. The carpet vacuum cleaner in claim 8 wherein said filter means comprises at least one inverted open bottom filter tube; and spring means in said tube for normally retaining said tube in extended condition but allowing distortional depression of said tube with compression of said spring means, for dislodging of dirt from said tube.

* * * * *

UNITED STATES PATENT AND TRADEMARK OFFICE

CERTIFICATE OF CORRECTION

PATENT NO. : 5,090,083

DATED : February 25, 1992

INVENTOR(S) : Richard E. Wulff

It is certified that error appears in the above-identified patent and that said Letters Patent is hereby corrected as shown below: On the Title page, item [57], Abstract, line 13:
"operable" should be --operably--.

Column 2, line 63:
After "scuffing" insert --.--.

Column 4, line 20:
After "thereof" insert --.--.

Column 4, line 51:
After "hopper" insert --.--.

Column 4, line 55:
After "desired" insert --.--.

Column 6, claim 7, line 41:
After "Claim 6" insert --wherein--.

Signed and Sealed this

Seventeenth Day of August, 1993

Bruce Lehman

*Attest:*

BRUCE LEHMAN

*Attesting Officer*

*Commissioner of Patents and Trademarks*